US005115610A

United States Patent [19]

Kessler

[11] Patent Number: 5,115,610

[45] Date of Patent: May 26, 1992

[54] GLAZING BEAD

[76] Inventor: Gerald Kessler, P.O. Box 389, Youngstown, Ohio 44501

[21] Appl. No.: 557,039

[22] Filed: Jul. 25, 1990

[51] Int. Cl.[5] ..... E04B 1/61; E04B 1/62

[52] U.S. Cl. ..... 52/397; 52/773; 52/775

[58] Field of Search ..... 52/397, 398, 399, 656, 52/775, 235, 127.5, 127.8, 776, 766, 471, 474, 476, 773, 777, 780

[56] References Cited

U.S. PATENT DOCUMENTS

| | | | |
|---|---|---|---|
| 1,223,609 | 4/1917 | Peters . | |
| 3,016,993 | 1/1962 | Owen . | |
| 3,111,727 | 11/1963 | Gerecke | 52/207 |
| 3,196,998 | 7/1964 | Owen . | |
| 3,487,601 | 12/1967 | James . | |
| 3,674,082 | 7/1972 | Letarte . | |
| 3,872,638 | 3/1975 | Di Fazio . | |
| 3,982,371 | 9/1976 | Dreu | 52/775 |
| 4,092,813 | 6/1978 | Eggert | 52/397 |
| 4,132,044 | 1/1979 | Rollyson . | |
| 4,335,552 | 6/1982 | Blanchett et al. . | |
| 4,463,535 | 8/1984 | Wendt . | |
| 4,525,966 | 7/1985 | Litchfield et al. . | |
| 4,555,884 | 12/1985 | van Eerden . | |
| 4,742,664 | 5/1988 | Johnson . | |

FOREIGN PATENT DOCUMENTS

| | | | |
|---|---|---|---|
| 716333 | 8/1965 | Canada | 52/397 |
| 2631315 | 7/1976 | Fed. Rep. of Germany | 52/397 |
| 2435594 | 5/1980 | France | 52/208 |

*Primary Examiner*—David A. Scherbel
*Assistant Examiner*—Robert Canfield
*Attorney, Agent, or Firm*—Browdy and Neimark

[57] ABSTRACT

An extruded plastic glazing bead 1 for securing a window 17, 19 which removably locks into place by a resilient locking structure 9 has an elastic cushioning part 7, coextruded with the glazing bead, which makes contact with the frame 15, and thus acts in securing and removing the glazing bead.

13 Claims, 3 Drawing Sheets

GLAZING BEAD

FIELD OF THE INVENTION

The present invention relates to glazing beads for securing windows or panels in frames and more particularly to a glazing bead which locks into place but which can be easily removed for servicing a broken glass.

BACKGROUND

Glazing beads have long been known for holding panels and glass panes in appropriate frame members. Among the patent literature there may be mentioned the U.S. Pat. Nos. to James 3,487,601; Wendt 4,463,535; Letarte 3,674,082; Rollyson 4,132,044; Blanchett 4,335,552; preu 3,982,371; Litchfield 4,525,966; Johnson 4,742,664; Peters 1,223,609; Owen 3,196,998; van Eerden 4,555,884; Owen 3,016,993; and Di Fazio 3,872,638. Among these, there are known glazing beads which snap lock into place in one way or another, such as those shown in the U.S. Pat. Nos. to Johnson '664, the Blanchett et al patent '552 and the Rollyson patent '044. Some of these have portions which are springy, flexible or elastic such as James patent '601 and Preu patent '371.

Those glazing beads shown in the aforementioned U.S. patents are typical and many others have appeared in the marketplace over the years. These prior constructions have come and gone, and most have served in a suitable but not fully satisfactory fashion. Insofar as is known, however, no prior glazing bead construction has met the requirements of being easily installed to lock the panel or pane in place, constructed in such a way so that the panel or pane is well retained with the glazing bead being positively locked in the extruded sash with little or no chance of accidental uncoupling, while still being capable of easy unlocking and withdrawal for removal of a broken pane or panel. The prior glazing bead constructions can either not be removed once they are installed, can be removed only with great difficulty with substantial force required to overcome large frictional forces as portions of the glazing bead are dragged across the surface of the pane or panel, or they fail to lock in a sufficiently positive manner and can thus be accidentally displaced, or they suffer from two or more of these defects.

SUMMARY OF THE INVENTION

It is an object of the present invention to overcome deficiencies of the prior art, such as indicated above.

It is a further object of the present invention to provide a rigid glazing bead which can be easily installed, easily removed for servicing a broken glass, and then easily replaced.

It is another object of the present invention to provide an effective and inexpensive glazing bead.

It is yet another object of the present invention to provide a glazing bead which is easily locked into place.

It is yet a further object of the present invention to provide an improved glazing bead which is made together with a dual purpose lift handle as a unitary structure.

The above and other objectives are accomplished by the use of a glazing bead at the top and/or bottom of the sash, the glazing bead having both flexible and rigid portions and a snap lock to lock the bead in place in the sash frame against the panel or glass pane, and wherein the glazing bead is unlockable and removable by sliding in a plane parallel to the plane of the panel or pane, such sliding motion causing a compression or deformation of a flexible part of the bead so as to "clear" an interlocked position.

In more detail, the invention concerns a glazing bead which is predominantly rigid, but which has a flexible portion and at least one elastic portion which acts as a spring, the glazing bead being used to lock a panel or glass pane into a generally L-shaped sash frame in a relatively easily removable manner, the glazing bead and the generally L-shaped frame having interengaging locking members. In cross-section, the locking bead has a substantially rigid portion which extends co-planar to the pane or panel holding the pane or panel in place between its inside surface and an opposite parallelly extending inside surface of the upwardly extending leg of the L-shaped frame member. Extending downwardly in generally the same plane as the substantially rigid main portion of the locking bead is a partly flexible locking arm which is adapted to slide into and snap-lock within a recess near the end of the foot of the L-shaped sash frame member. A key feature of the locking bead is the spring-like elastic portion having a height (extending in a plane generally parallel to the plane of the pane or panel) approximately equal to or at least slightly greater than the height of the snap lock, this spring-like elastic portion abutting against the upper surface of the end of the foot of the L-shaped frame member to bias the lock in its locked position. In addition, the locking bead optionally and preferably has a second elastic or flexible portion which projects inwardly from its inner surface so as to contact a face of the panel or glass pane.

Further objects and the nature and advantages of the present invention will be more apparent from the following detailed description of an embodiment of the invention, taken in conjunction with the drawing, wherein:

DETAILED DESCRIPTION OF THE PREFERRED EMBODIMENT

Figure 1:
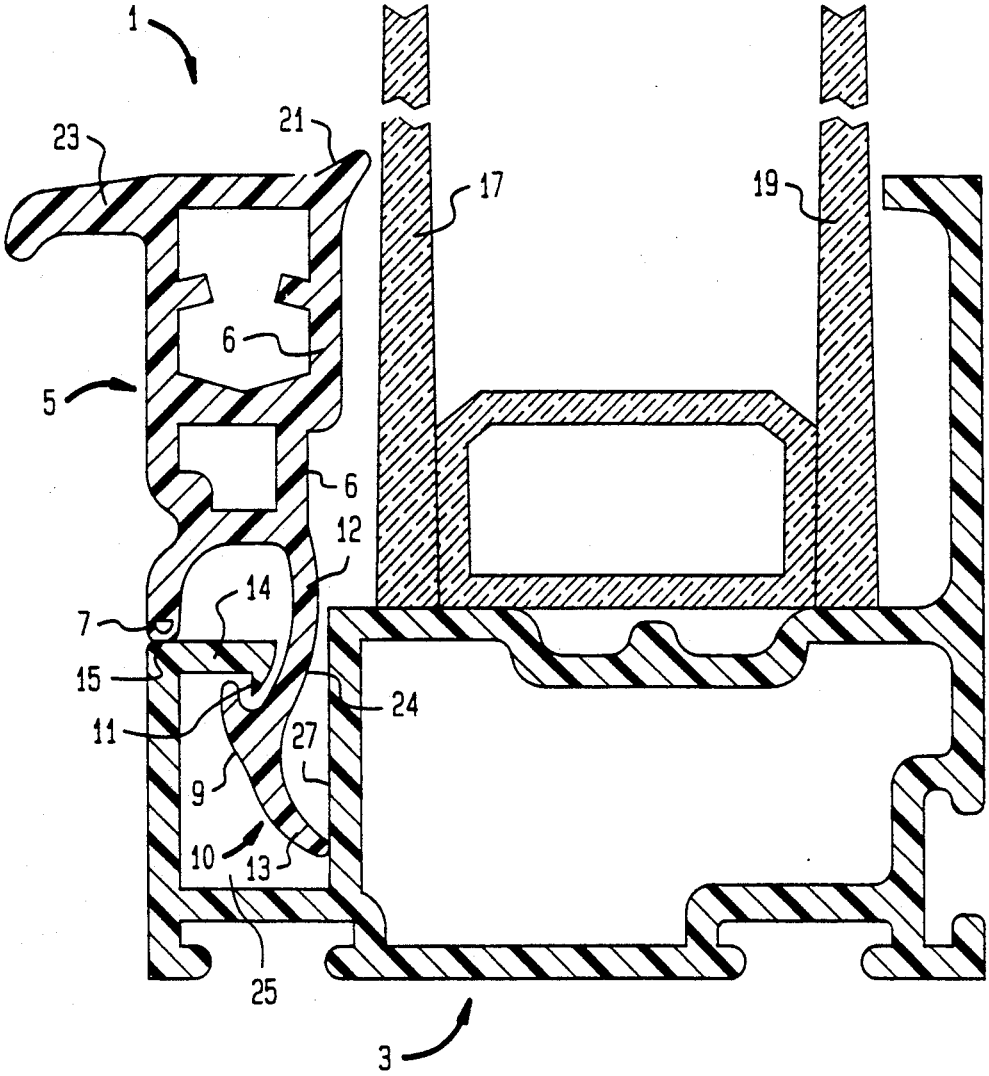
FIG. 1 shows a cross-sectional view of a glazing system for a window in accordance with the present invention.

Referring now to FIG 1, a preferred embodiment of the glazing bead 1 of the present invention is shown locked into position in a sash frame 3. The glazing bead 1, designed particularly for use on one of both of the horizontal sash members on the inside of the window, includes a main body portion 5 having a generally rectangular cross-section having a long surface 6 extending adjacent and parallel to the glass pane 17, and an interiorly directed lifting handle 23 which is preferably extruded along with the body 5 in a one piece plastic extrusion. The main function of the handle 23 is in the raising and lowering of the vertically slidable window sash in the conventional manner. However, the handle will also be available when needed for grasping the glazing bead 1 in its insertion and removal from the sash frame 3 as needed.

The glazing bead 1 also includes an integral coextruded elastic cushioning part 7 which makes contact with an exterior face 15 of a wall 14 of the sash frame 3 as the glazing bead 1 is secured in its locked-in-place position. The cushioning piece 7 is preferably made of soft polyvinyl chloride coextruded as a dual durometer part with the rigid PVC body 5 of the glazing bead 1. The glazing bead of the present invention will preferably, although optionally, also have a second cushioning part 21, also preferably integrally coextruded as a dual durometer part with the body 5 of the glazing bead I. The second cushioning part 21 provides soft cushioning contact between the glazing bead 1 and the adjacent pane 17 of the window, as is generally known.

Extending generally parallel to the height of the body portion 5 is a locking portion 10 of rigid plastic, comprising a connecting arm 12 which because of its relative thinness, desirably on the order of 60 mils, is capable of flexing, the arm 12 terminating in a catch piece 13 having a locking tip 9. In turn, the sash 3 has a cavity 25 in part defined by the upper wall 14 which terminates to form a mouth 24 of the cavity 25. The upper wall 14 desirably has a catch 11 for interlocking with the locking tip 9 of the locking portion 10 of the glazing bead 1.

The height of the elastic portion 7 must be correlated to the degree of movement of the glazing bead 1 relative to the sash 3 in order to unlock the bead 1 from the sash 3, i.e. in the FIG. 1 embodiment the length of movement necessary to permit the tip 9 to clear the catch 11. In the embodiment of FIG. 1, it has been found that a height on the order 125 mils is satisfactory for the elastic portion 7 when the height of the catch 11 is 30–60 mils.

Figure 3:
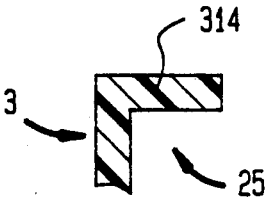
FIGS. 3 and 4 show variations in the configuration of the sash locking means for cooperating with the lock of the glazing bead.
Figure 4:
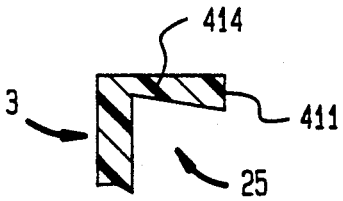

FIGS. 3 and 4 show possible variations in the upper wall defining the cavity 25 of the extruded sash. In FIG. 3 the upper wall 314 has no downwardly extending catch such as the catch 11 in the preferred embodiment of FIG. 1. In the embodiment of FIG. 2, it will be understood that the height of the elastic part 12 of the glazing bead can be significantly reduced. In FIG. 4 the upper wall 414 is tapered so as to be thicker at its free end, so that in effect such thickened free end, the bottom surface of which projects partly downwardly, provide a catch 411. Similar and other changes to the locking portion 10 of the glazing bead 1 will also be readily apparent.

The glazing bead is driven into place by a force parallel to the pane or panel far enough to clear the catch for the positive snap lock. Spring action of the elastic part and pulling of the lift handle sets the bead in place. Removal of the glazing bead is accomplished by pushing the glazing bead parallel to the glass toward compression of the elastic part of the bead until the lock clears. The bead is then pushed towards the glass and pulled out by a force parallel to the glass.

Figure 2A:
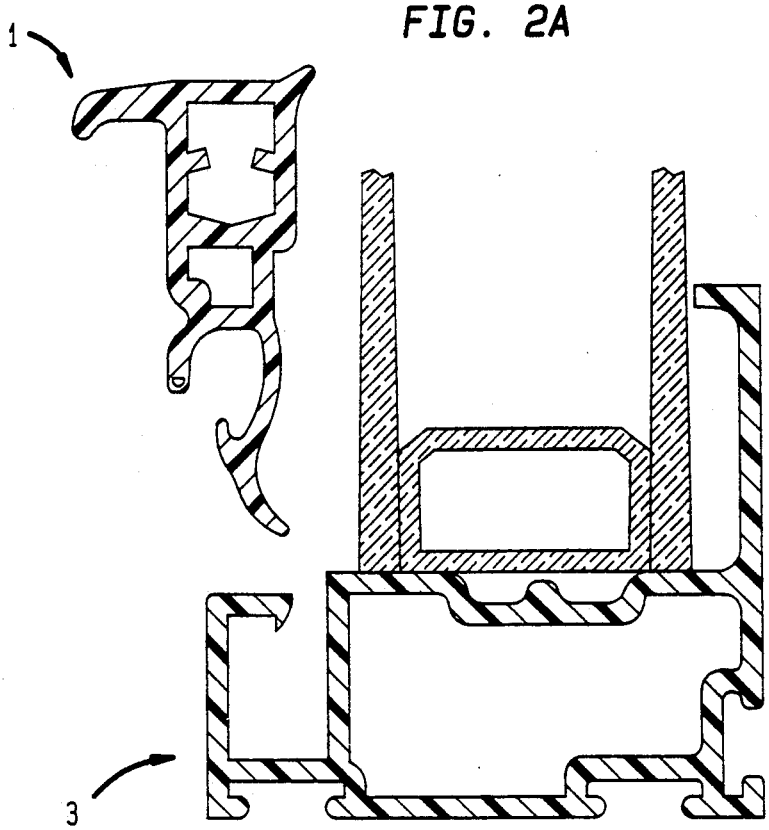
FIGS. 2A through 2D show Various steps in the process of locking the glazing bead into place in accordance with the present invention.

The series of FIGS. 2A through 2D illustrate insertion of the glazing bead 1 into the sash frame 3. FIG. 2A shows the glazing bead 1 prior to placement in the sash frame 3.

Figure 2B:
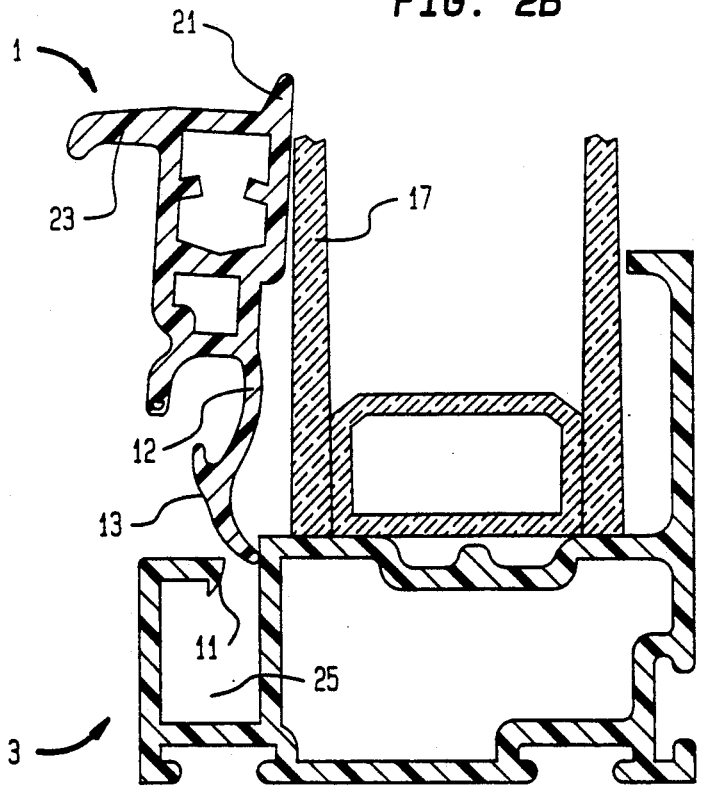

In FIG. 2B, the glazing bead 1, hand held by the handle 23, is pressed against the window pane 17. The optional contact cushion 21 is displaced from its normal position. Catch piece 13 of the glazing bead which extends away from the glazing bead 1 is slowly inserted past the catch 11 of the sash frame 3 into the retaining cavity 25, as the arm 12 flexes.

Figure 2C:
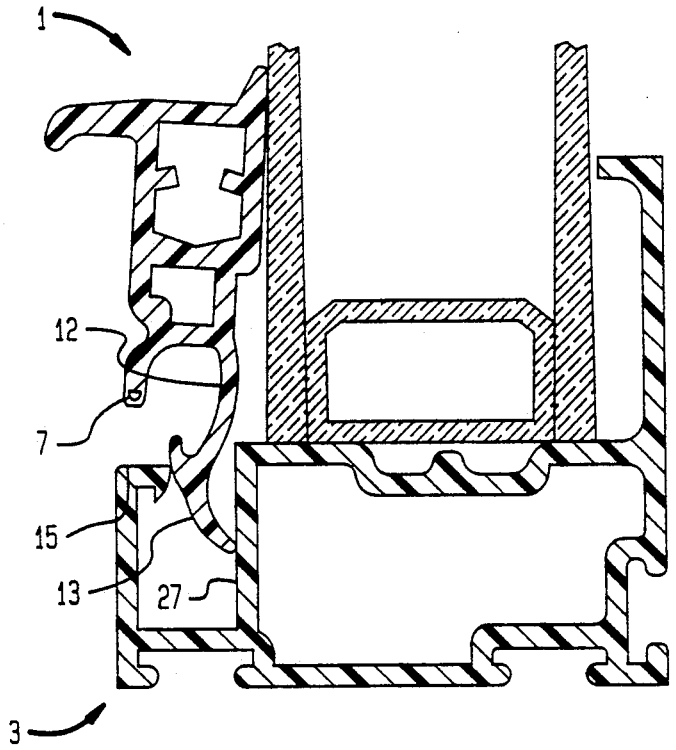

FIG. 2C shows the glazing bead further in the insertion process. Catch piece 13 preferably slides down the facing wall 27 of the sash frame 3. The arm 12 further bends or flexes to facilitate insertion. The coextruded cushioning piece 7, in FIG. 2C, has just begun to make contact with the face 15 of the sash frame 3.

Figure 2D:
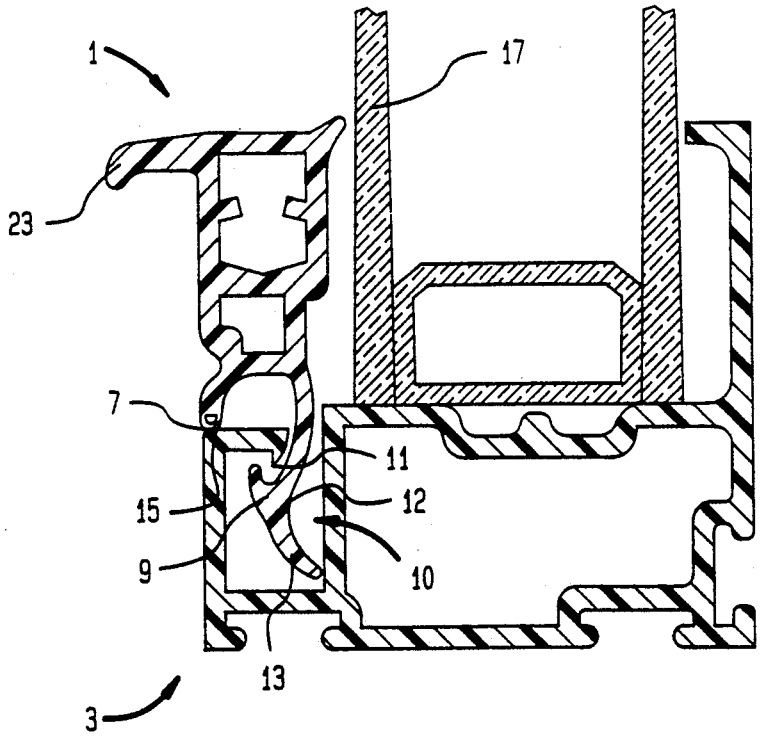

In FIG. 2D the locking portion 10 of the glazing bead has been further inserted into the cavity 25 of the frame 3 forcing cushioning piece 7 to become compressed against the outer face 15 of the upper wall 14 of the frame 3. The locking tip 9 of the catch piece 13 begins to clear the catch 11. A little more force at the handle 23 in the direction towards the frame 3 and parallel to the window pane 17 causes the tip 9 of the catch piece 13 to slide past catch 11, locking the glazing bead 1 into place as shown in FIG 1 as the arm 12 snaps back into its original position.

The glazing bead 1 can be removed from the locked in position in frame 3, as shown in FIG 1, very easily. Using the handle 23, a force is applied downwardly parallel to the window pane 17 compressing the elastic cushioning part 7 until the condition shown in FIG. 2D is reached. At this time a force towards and perpendicular to window pane 17 is applied at handle 23 causing the arm 12 to flex and the locking tip 9 to slip past catch 11 so that the glazing bead 1 can be removed with an upwardly directed force parallel to window pane 17 and away from the sash frame 3.

It will be understood from the description above that the elastic cushioning part 7 essentially functions like a spring so that in its uncompressed state as illustrated in Fig. 1 it keeps the glazing bead 1 in its illustrated interlocked position, even if the glazing bead is dimensioned so as to fit somewhat looser than is conventional in the prior art. Upon compression of the elastic part 7 as illustrated in FIG. 2D and as already explained above, the elastic part 7 functions as a means for permitting unlocking of the sealing bead 1 from the locking recess 25.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. In a glazing bead for holding a panel or a pane of glass in a frame member having a locking cavity for interlocking with said glazing bead, said glazing bead comprising:

a rigid body portion elongated in a first direction and adapted to extend in said first direction parallel to and abut in a second direction against and retain a panel or glass pane, said body portion being formed of rigid plastic material, a partly flexible locking arm extending in said first direction and adapted to slide into a locking cavity of the frame member in said first direction, and a locking portion extending from said partly flexible locking arm and being adapted to lock within the locking cavity of the frame member, the improvement comprising:

an elastic part integral with said rigid body portion of said glazing beam extending in said first direction and adapted to abut against a first surface of the frame member extending perpendicular to the panel or pane, said elastic part comprising spring means for assisting in maintaining said locking portion in locked position within the frame member when said elastic part is relatively uncompressed and for facilitating unlocking of said locking portion from the frame member when relatively compressed.

2. The glazing bead of claim 1 wherein said soft elastic part is dual durometer coextruded with said glazing bead.

3. A glazing bead according to claim 1 further comprising an integral lifting handle.

4. A glazing bead according to claim 3 wherein said integral handle is extruded as part of said glazing bead.

5. A glazing bead according to claim 1 wherein said rigid body portion has a generally rectangular cross-section having a long surface adapted to extend adjacent and parallel to the panel or pane, and a short surface extending generally perpendicular to said long surface and adapted to extend adjacent the first surface of the frame member, said elastic part extending outwardly from said short surface.

6. In a frame holding a panel or a pane of glass, the frame comprising at least one generally L-shaped frame member having a first surface (15) extending perpendicular to said panel or pane and a locking cavity beneath said first surface, and a glazing bead locked within the cavity of said frame member for holding said panel or pane of glass within said frame;

said glazing bead comprising an elongated rigid body portion elongated in a first direction and extending parallel to and abutting in a second direction against said panel or glass pane so as to retain said panel or glass pane in said frame, said body portion being formed of rigid plastic material, a partly flexible locking arm extending in said first direction from said body portion within said locking cavity, and a locking portion extending from said partly flexible locking arm and locked within the locking cavity of the frame member, the improvement comprising:

an elastic part integral with said rigid body portion of said glazing bead extending in said first direction and abutting against said first surface (15) of said frame member, said elastic part comprising spring means for assisting and maintaining said locking portion in locked position within said frame member when said elastic part is relatively uncompressed and for facilitating unlocking of said locking portion from said frame member when relatively compressed.

7. A construction according to claim 6 wherein said frame is a window sash and said frame member is a horizontal member of said window sash.

8. A construction according to claim 7 wherein said soft elastic part is dual durometer co-extruded with said glazing bead.

9. A construction according to claim 7 wherein said glazing bead further comprises an integral lifting handle.

10. A construction according to claim 9 wherein said integral handle is extruded as part of said glazing bead.

11. A construction according to claim 7 wherein said rigid body portion has a generally rectangular cross-section having a long surface extending adjacent and parallel to said glass pane, and a short surface extending generally perpendicular to said long surface and adjacent said first surface of the frame member, said elastic part extending outwardly from said short surface.

12. A glazing bead according to claim 1 wherein said rigid portion further has a soft cushioning part extending outwardly therefrom in said second direction.

13. A construction according to claim 6 wherein said rigid body portion has a soft cushioning part extending outwardly therefrom in said second direction and abutting against said panel or glass pane.

* * * * *